US008207902B1

(12) United States Patent
Tam

(10) Patent No.: US 8,207,902 B1
(45) Date of Patent: Jun. 26, 2012

(54) BROADBAND HF SHIP MAST CAGE ANTENNA

(75) Inventor: Daniel W. S. Tam, San Diego, CA (US)

(73) Assignee: The United States of America as represented by the Secretary of Navy, Washington, DC (US)

( * ) Notice: Subject to any disclaimer, the term of this patent is extended or adjusted under 35 U.S.C. 154(b) by 724 days.

(21) Appl. No.: 12/353,125

(22) Filed: Jan. 13, 2009

(51) Int. Cl.
*H01Q 1/34* (2006.01)
*H01Q 1/12* (2006.01)

(52) U.S. Cl. ..... 343/710; 343/874; 343/891

(58) Field of Classification Search ..... 343/709, 343/710, 874, 890, 891; 52/651.02, 40
See application file for complete search history.

(56) References Cited

U.S. PATENT DOCUMENTS 2,987,721 A * 6/1961 Edwards et al. ..... 343/725
3,001,194 A * 9/1961 Leppert ..... 343/792
3,189,906 A * 6/1965 Kulik et al. ..... 343/710

* cited by examiner

*Primary Examiner* — Jacob Y Choi
*Assistant Examiner* — Robert Karacsony
(74) *Attorney, Agent, or Firm* — Kyle Eppele; J. Eric Anderson

(57) ABSTRACT

A broadband cage antenna about a mast of a vessel is described, containing a first plurality of wires aligned in a substantially vertical orientation and arranged circumferentially around the mast; a second plurality of wires aligned in a substantially horizontal orientation and placed around the mast, a first wire of the second plurality of wires joining, near a top portion of the mast, all the first plurality of wires, and a second wire of the second plurality of wires joining, near a bottom portion of the mast, all the first plurality of wires; and an antenna feed coupled to the second wire of the second plurality of wires, wherein the first and second plurality of wires are electrically insulated from the mast, to form a broadband antenna having a VSWR response of less than 4 over a designated frequency range.

20 Claims, 8 Drawing Sheets

BROADBAND HF SHIP MAST CAGE ANTENNA

FEDERALLY-SPONSORED RESEARCH AND DEVELOPMENT

This invention (Navy Case No. 099086) is funded by the United States Department of the Navy. Licensing inquiries may be directed to the Office of Research and Technical Applications, Space and Naval Warfare Systems Center, San Diego, Code 2112, San Diego, Calif., 92152; voice 619-553-2778; email T2@spawar.navy.mil.

BACKGROUND

This disclosure relates to communication systems. More particularly, this disclosure relates to a broadband cage antenna system surrounding a ship's mast.

SUMMARY

The foregoing needs are met, to a great extent, by the present disclosure, wherein systems and methods are provided that in some embodiments provide for a broadband antenna composed of open wires disposed over a ship's mast.

In accordance with one aspect of the present disclosure, a broadband cage antenna about a mast of a vessel is provided, comprising: a first plurality of wires aligned in a substantially vertical orientation and arranged circumferentially around the mast; a second plurality of wires aligned in a substantially horizontal orientation and placed around the mast, a first wire of the second plurality of wires joining, near a top portion of the mast, all the first plurality of wires, and a second wire of the second plurality of wires joining, near a bottom portion of the mast, all the first plurality of wires; and an antenna feed coupled to the second wire of the second plurality of wires, wherein the first and second plurality of wires are electrically insulated from the mast, to form a broadband antenna having a VSWR response of less than 4 over a designated frequency range.

In accordance with another aspect of the present disclosure, a broadband cage antenna about a mast of a vessel is provided, comprising: a plurality of first conducting means for conducting electrons, aligned in a substantially vertical orientation and arranged circumferentially around the mast; a plurality of second conducting means for conducting electrons aligned in a substantially horizontal orientation and placed around the mast, a first conducting means of the plurality of second conducting means joining, near a top portion of the mast, all the plurality of first conducting means, and a second conducting means of the plurality of the second conducting means joining, near a bottom portion of the mast, all the plurality of the first conducting means; and a feeding means for receiving/transmitting electricity, coupled to the second conducting means of the plurality of the second conducting means, wherein the pluralities of the first and second conducting means are electrically insulated from the mast, to form a broadband antenna having a VSWR response below 4 over a designated frequency range.

In accordance with another aspect of the present disclosure, a method for A method for broadband coupling of electromagnetic waves using a cage of wires placed about a mast of a vessel, comprising: aligning a first plurality of wires in a substantially vertical orientation in a circumferential arrangement around the mast; aligning a second plurality of wires in a substantially horizontal orientation around the mast; joining a first wire of the second plurality of wires, near a top portion of the mast, to all the first plurality of wires; joining a second wire of the second plurality of wires, near a bottom portion of the mast, to all the first plurality of wires; and coupling an antenna feed to the second wire of the second plurality of wires, herein the first and second plurality of wires are electrically insulated from the mast, to form a broadband antenna having VSWR response of less than 4 over a designated frequency range.

DETAILED DESCRIPTION

Figure 1:
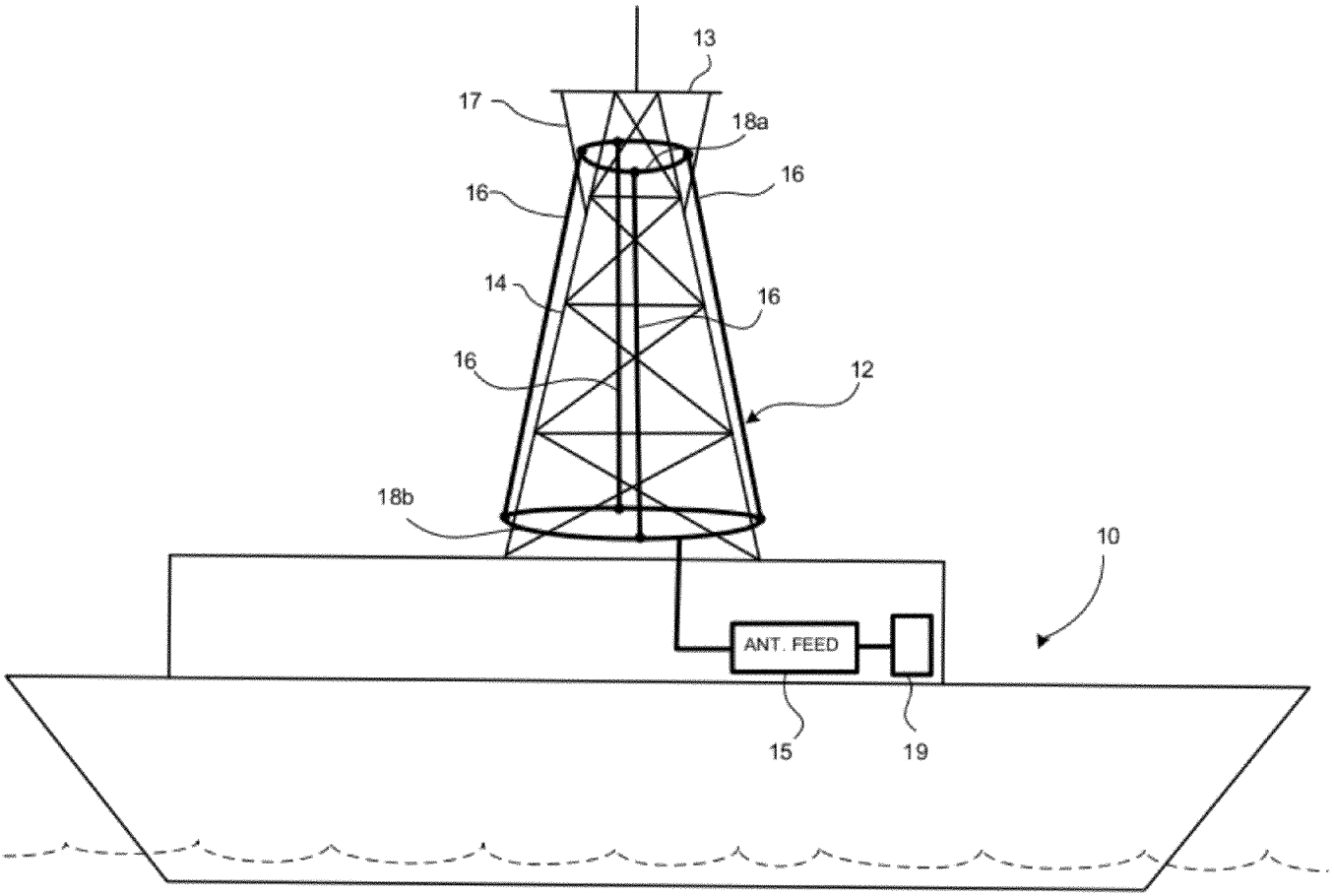
FIG. 1 is an illustration of an exemplary cage antenna on a ship's mast.

Antennas and their placement on a ship are an ongoing concern with large and small vessels. This concern is exacerbated with the need for deployment of multiple antennas in a limited space platform, particularly on the deck of a warfaring vessel. As such, the ship's mast has been used as the principal platform for placing antennas. Because the mast is elevated from the deck of the ship, it offers less interference for the antennas. However, most of the ship's existing antennas are already on the mast, rendering it difficult to attach any additional antennas without increased inter-antenna interference. Also, high frequency (HF) antennas are understood to be physically large, rendering them to be difficult to position on the mast without interference, either physically or electromagnetically.

As disclosed below, a proposed solution is to use a cage antenna that is situated about the mast. Specifically, a cage antenna is fitted to the mast as a wire frame. The openness of the cage antenna enables it to be placed near the mast without physically blocking other antennas on the mast, and it is understood not to electrically interfere with these other antennas because of its frequency differentiation. The wires are placed in a predominately longitudinal orientation, stretching from the base of the mast to an upper portion of the mast. In the context of this disclosure, the term "vertical" may be used as a proxy to the term "longitudinal" and is understood to connote a general direction rather than an absolute form. Also, it should be noted that the wires described herein, may be covered with insulation to provide a degree of protection and/or resilience to the elements.

In this exemplary configuration, the cage antenna and the mast can be designed to operate as coupled mutual impedances. By varying the distance and shape of the cage from the surface of the mast, the coupling can be adjusted to affect the resulting frequency response. Also, by varying the height of the cage, the frequency response can be changed. Therefore, the complex mast geometry with the cage antenna can form the equivalent of a "fat" monopole antenna, which is known to have broadband capabilities. Based on this understanding, measurements and experiments have been performed to evaluate the broadband performance of a cage antenna positioned around a ship's mast.

In the experiments shown below, a 1:48 scale model of the cage antenna is placed over a 1:48 scale model of a ship's mast and evaluated from scale frequencies of 96.0 MHz to 432.0 MHz. Given that a 1:48 scale is used, the scale frequencies can be converted to non-scale frequencies by simply dividing by 48. For example, a scale frequency of 350 MHz is equivalent to a non-scale frequency of 7.29 MHz. (i.e., 350/48=7.29). Of note in the following Figures is that under certain protocols, an antenna can be considered "acceptable" if it demonstrates a voltage standing wave ratio (VSWR) of less than 4 over a non-scale frequency range of 2-7 MHz. Accordingly, if a 1:48 scale antenna demonstrates a VSWR of less than 4 between 96 MHz to 336 MHz, it is understood that a non-scaled version of the antenna will be an acceptable broadband antenna.

FIG. 1 is a diagram illustrating a ship 10 with an exemplary cage antenna 12 positioned about the ship's mast 14. The exemplary cage antenna 12 is composed of four vertically oriented wires 16 and two horizontally oriented rings, upper ring 18*a* and lower ring 18*b*, to form upper and lower sections of the cage antenna 12. The upper ring 18*a* is placed just below the top yard arm 13 of the mast 14 and runs through the closed loop formed by the mast 14, the top yard arm 13, and support members 17. The lower ring 18*b* is placed at the base of the mast 14. The vertically oriented wires 16 are connected to the two rings 18*a* and 18*b*, to bound the vertical arms of the cage antenna 12. On the lower ring 18*b*, a transmitter/receiver is 19 is attached to the cage antenna 12 via an antenna feed assembly 15.

It should be noted that while FIG. 1 illustrates the vertically oriented wires 16 as being substantially parallel to the ship's mast 14, the vertically oriented wires 16 may be bowed or shaped to provide the desired clearances and frequency responses, as needed, as also made apparent in the ensuing Figures. Also, the terms vertically oriented and horizontally oriented are understood to signify the general orientation of the wires and is not to be construed to provide an absolute, unyielding direction. Thus, these terms may be used with the term substantial to signify their overall orientation, without loss of generality.

The antenna feed assembly 15 may be located anywhere between the transmitter/receiver 19 and the cage antenna 12. The antenna feed assembly 15 may comprise several devices. For example, a current probe may be used in the antenna feed assembly 15 to excite/sample the cage antenna 12. Also, the antenna feed assembly 15 may be matched to the cage antenna 12 using a passive or active matching network. Further, an antenna tuner (e.g., frequency tuner—not shown) may be incorporated in the antenna feed assembly 15. Alternatively, a direct excitation of the cage antenna 12 may be utilized. Accordingly, it is apparent that multiple forms of antenna feed assemblies may be used, whether in combination with the devices described or with other devices/capabilities, as is known in the art. Therefore, modifications to the antenna feed assembly 15 and attendant devices may be made without departing from the spirit and scope of this disclosure.

It is noted that the vertically oriented wires 16 and horizontally oriented rings 18*a* and 18*b* are electrically insulated from the mast and the inherent ground plane formed by the ship's deck and ocean. Also, it is noted that while the exemplary embodiments described herein use only four vertically oriented wires 16, more or less wires may be used according to design preference. Out of simple convenience and for experimental expediency, only four vertically oriented wires 16 were utilized. However, in some instances, it may be desirable to use more or even less wires, depending on design objectives.

Using the exemplary cage antenna 12 shown in FIG. 1, a series of empirical measurements were performed, varying the length of the vertically oriented wires 16 (and ensuing separation distance from the mast 14) to test the performance of the overall antenna system. These performance tests were compared to baseline values and also to each other to see which cage configuration provided the best VSWR/Smith chart response. This was then matched with corresponding photos to visualize the physical shape.

An Anritsu S312D SiteMaster analyzer was used as the principal measuring device. The analyzer was used to measure the VSWR of the input which was transferred to a computer for Smith chart generation. In the experimental setup, a scale model of the mast 14 was secured to the ground plane with electrically conducting tape. With the scale model in place, the analyzer was calibrated and measurements were taken from 96-432 MHz. Photos were taken of the setup so that the VSWR results could be compared to the physical model.

Figure 2:
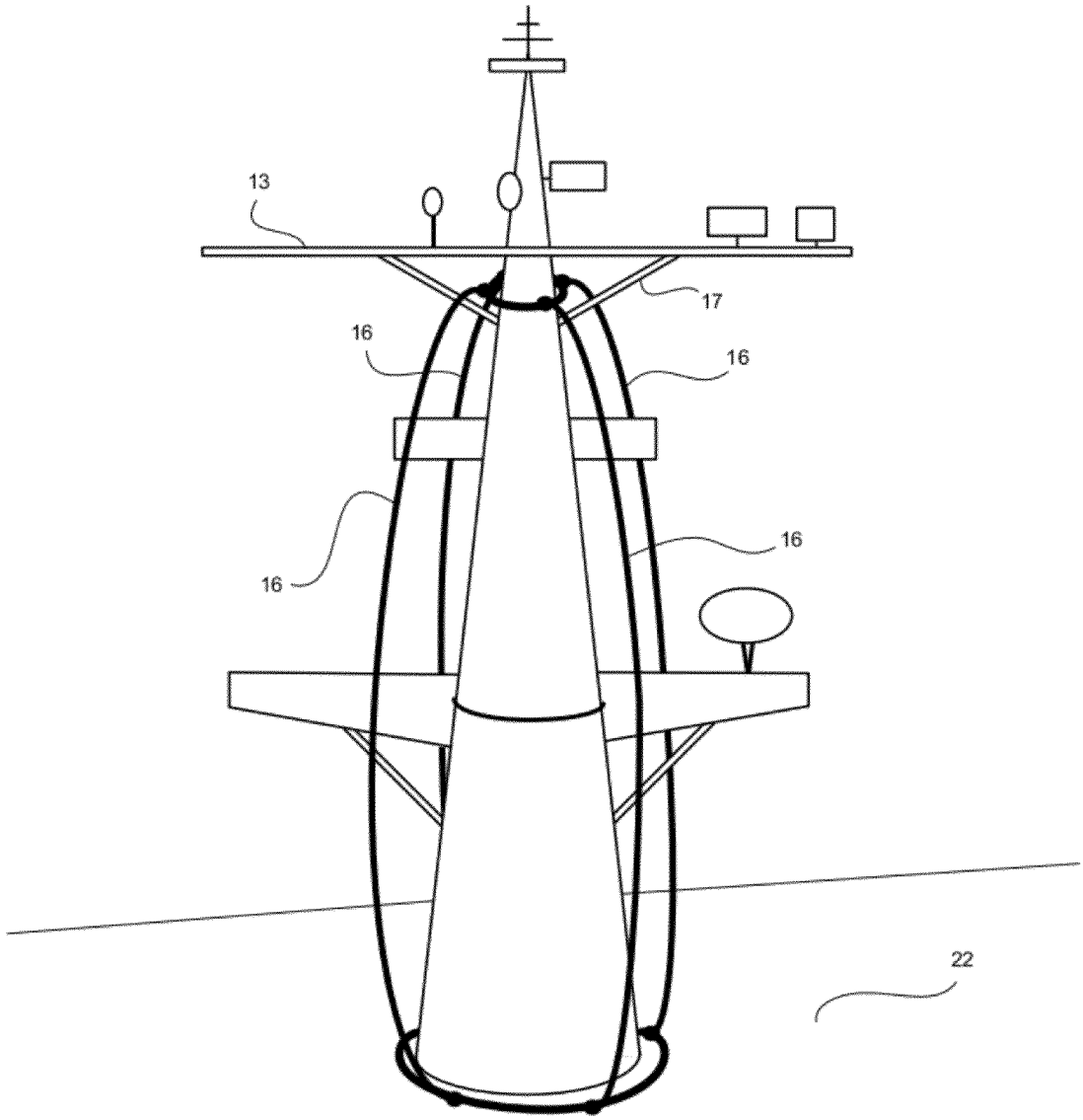
FIG. 2 is a representation of an exemplary scale cage antenna on a scale ship's mast over a small ground plane.

FIG. 2 is a representation of an exemplary 1:48 scale cage antenna on a 1:48 scale ship's mast, and is instructive in showing that the vertically oriented wires 16 may be curved. The outward curvature arises from the length of the vertically oriented wires 16 being longer than the actual height of the cage antenna. In consideration of the 1:48 scale, the vertically oriented wires 16 are equivalent to approximately 70 feet in straight length for a non-scaled antenna. The cage antenna system of FIG. 2 is shown as being tested inside a building. Consequently, the ground plane surface 22 of the cage antenna system is understood to be limited in size as compared to the ground available in an outdoor testing range.

Figure 3A:
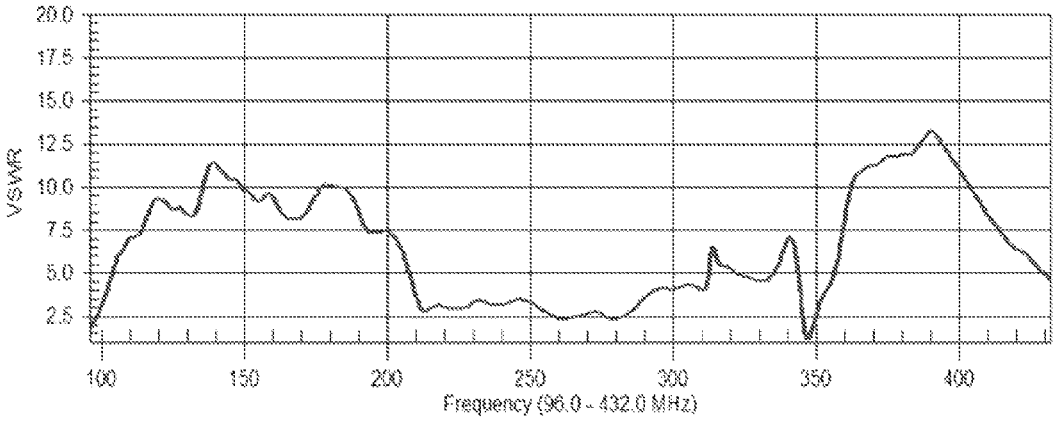
FIGS. 3A-B are VSWR and Smith chart response plots of the exemplary scale cage antenna system of FIG. 2.
Figure 3B:
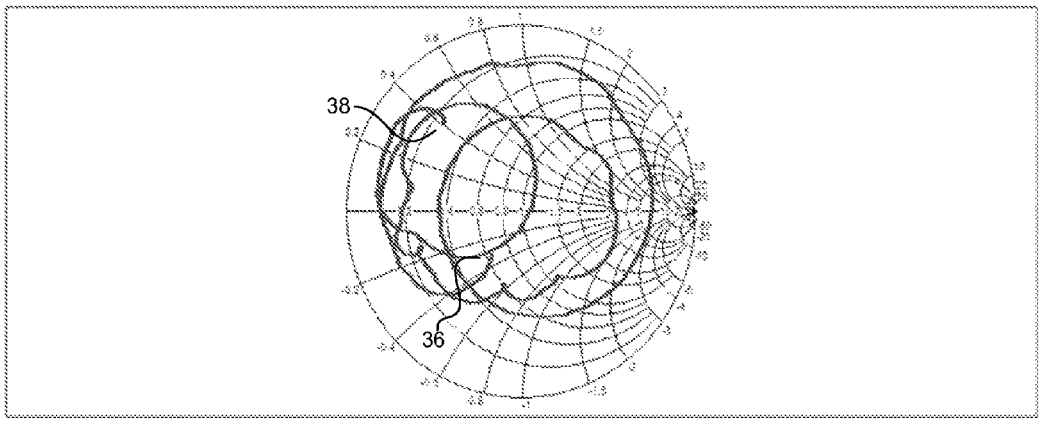

FIGS. 3A-B illustrate the VSWR and Smith chart response plots for the cage antenna system of FIG. 2. As noted earlier, if the VSWR can be constrained to be below 4 from 98-336 MHz, then is can be considered an "acceptable" broadband antenna. In this example, the VSWR plot of FIG. 3A shows that the cage antenna system demonstrates an unacceptable VSWR level (above 4) at the lower end of the plot and near the 336 MHz area of the plot. FIG. 3B reinforces this observation by showing the real and imaginary values of the input impedance of the cage antenna system cycling away from the center of the Smith chart through the different frequencies. The starting frequency of 98 MHz is illustrated by reference number 36 and the stopping frequency of 432 MHz is illustrated by reference number 38.

Given the poor performance of FIG. 2's cage antenna system, the lengths of the vertically oriented wires 16 were changed, as shown in the following Figures.

Figure 4:
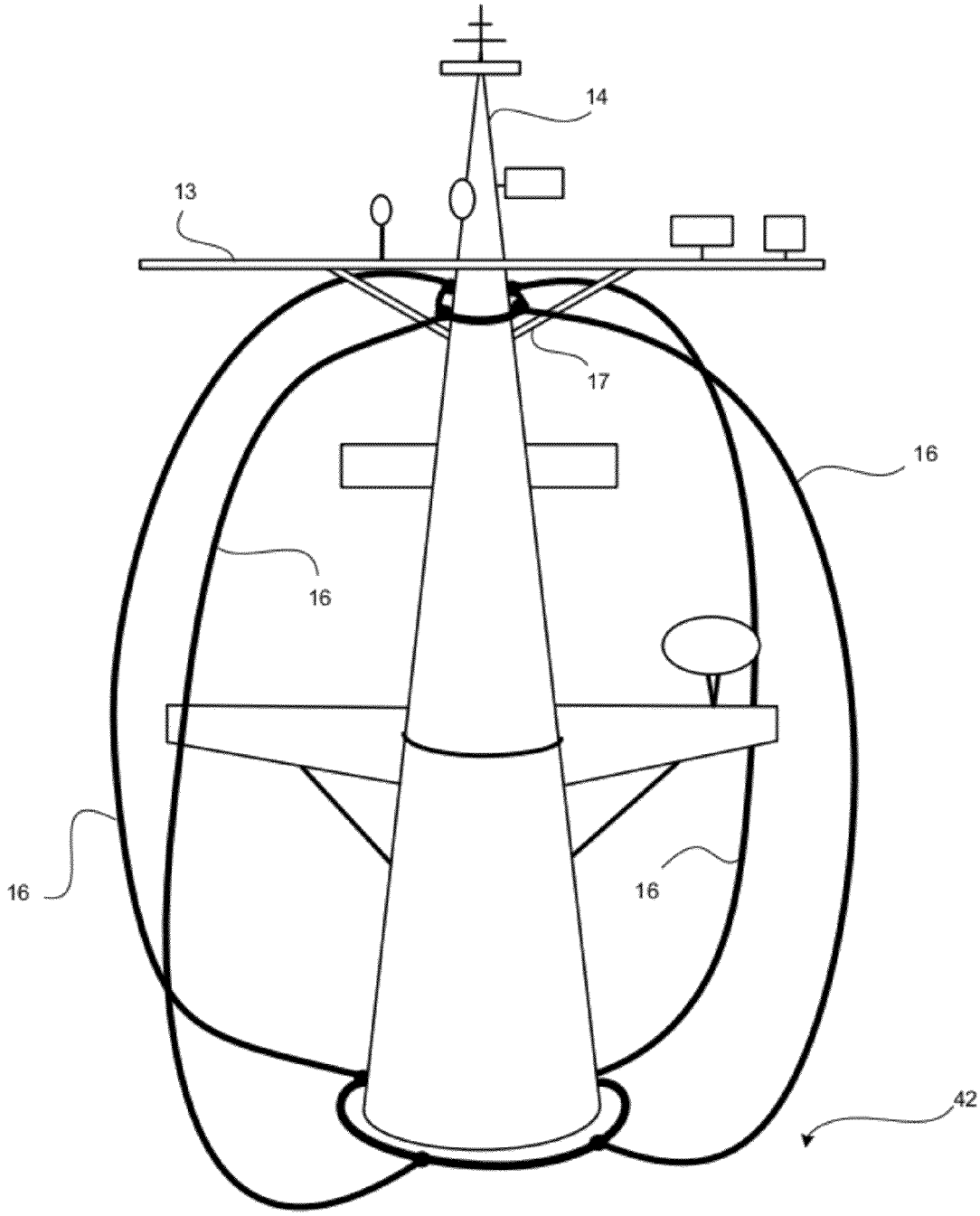
FIG. 4 is a representation of another exemplary scale cage antenna on a scale ship's mast over a large ground plane.

FIG. 4 is a representation of another exemplary scale cage antenna on a scale ship's mast over a large ground plane. FIG. 4's cage antenna system principally differs from FIG. 2's cage antenna system in that the vertically oriented wires 16 are approximately 100 feet in length (non-scale) and that testing was performed outdoors over a large ground plane 42. With longer vertically oriented wires 16, the cage antenna is more displaced from the ship's mast, forming more a spherical shape than that of FIG. 2's prolate shape.

Figure 5A:
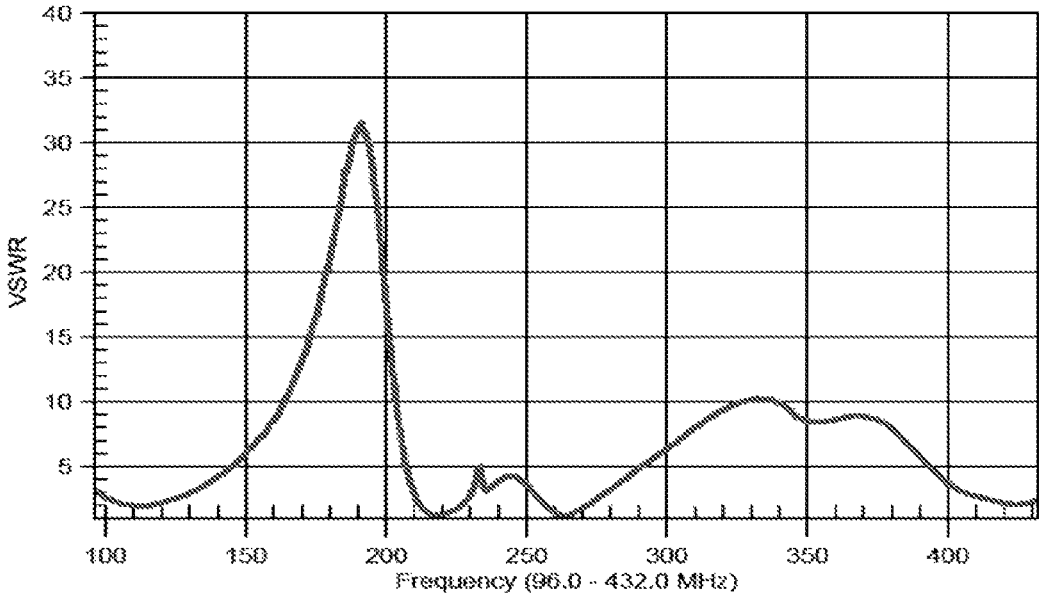
FIGS. 5A-B are VSWR and Smith chart response plots of the exemplary scale cage antenna system of FIG. 4.
Figure 5B:
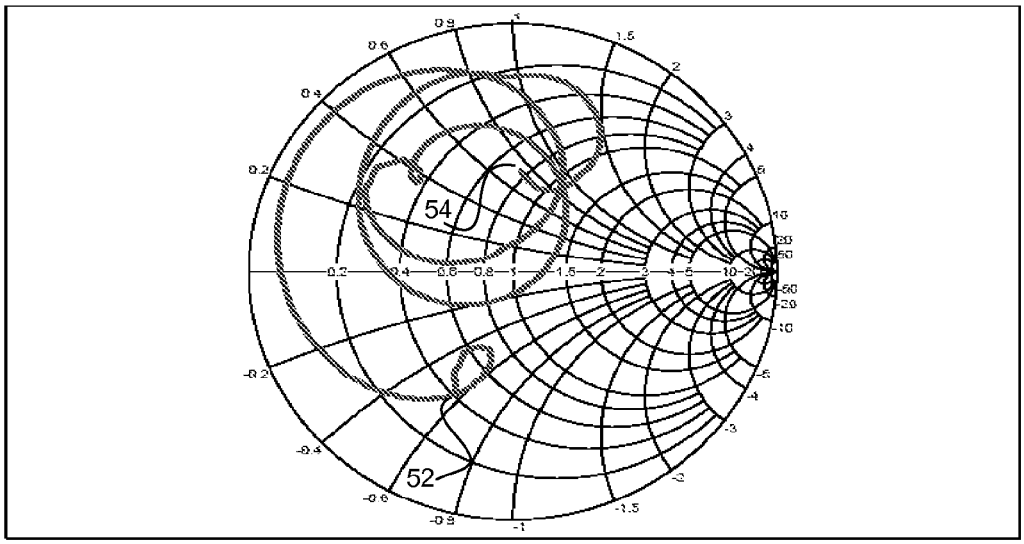

FIGS. 5A-B are VSWR and Smith chart response plots of the exemplary scale cage antenna of FIG. 4. From FIG. 5A, it is evident that an unacceptable VSWR level occurs near 200 MHz, rendering this antenna non-suitable for use. FIG. 5B's Smith chart details the real and imaginary input impedance track with starting frequency indicated by reference number 52 and stopping frequency indicated by reference number 54.

Figure 6A:
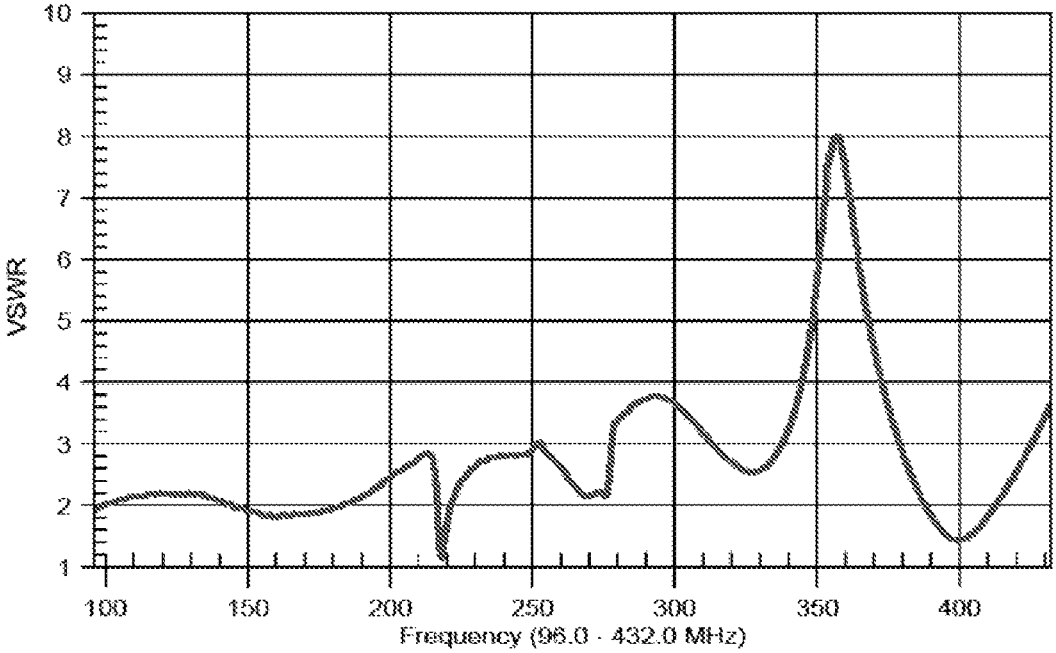
FIGS. 6A-B are VSWR and Smith chart response plots of another exemplary scale cage antenna system.
Figure 6B:
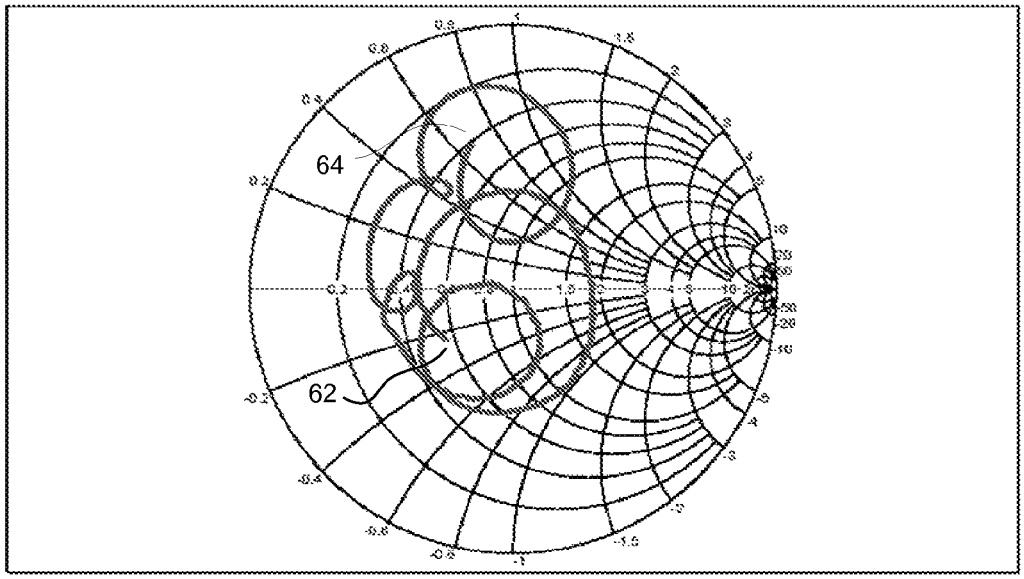

FIGS. 6A-B are VSWR and Smith chart response plots of another exemplary scale cage antenna with wires 16 of approximately 88 feet (non-scaled) in length. It is noted in FIG. 6A, that there is an unacceptable VSWR level occurring at approximately 360 MHz. However, this value is above the 336 MHz threshold (non-scaled frequency of 7 MHz) discussed above. And the VSWR values from 98 MHz to 336 MHz are below 4. Therefore, this cage antenna configuration fits within the requirements for an acceptable antenna. This is further evidenced in FIG. 6B, where the starting frequency point is indicated by reference number 62 and the stopping frequency point is indicated by reference number 64; and a smooth initial circle is traced about the center of the Smith chart, for the lower frequencies. In summary, the antenna of FIG. 6, using 88 feet long vertically oriented wires 16, is demonstrated as a suitable antenna for operation between 2-7 MHz.

Figure 7A:
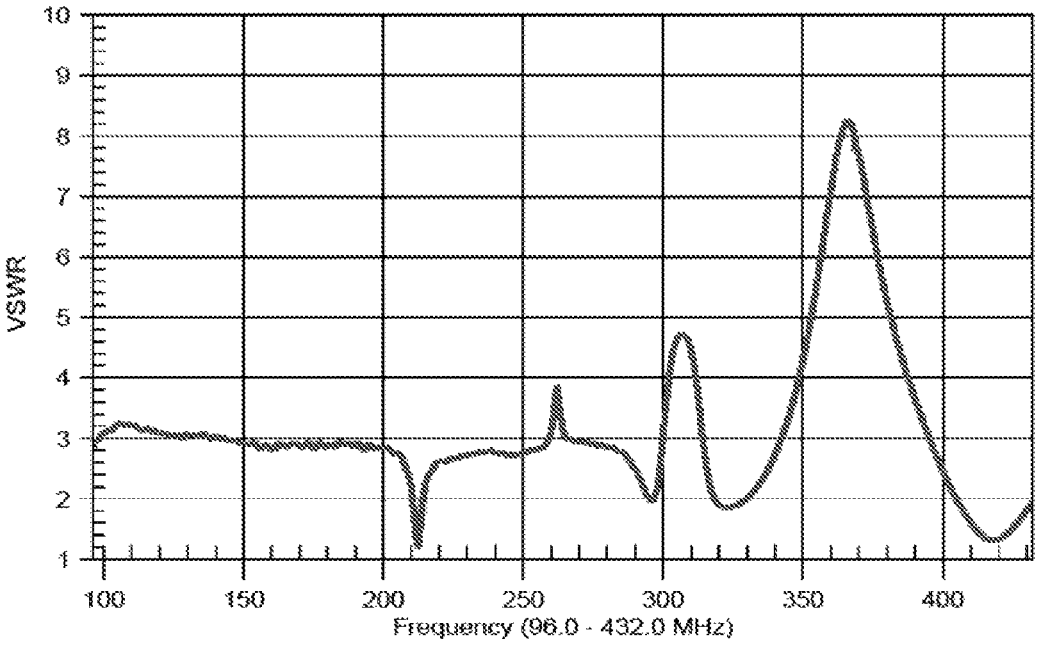
FIGS. 7A-B are VSWR and Smith chart response plots of another exemplary scale cage antenna.
Figure 7B:
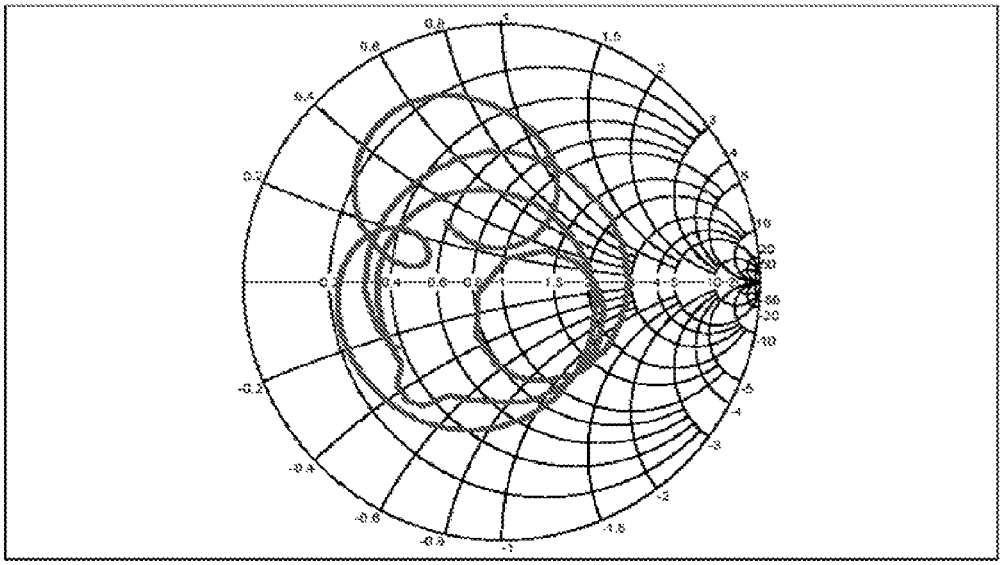

FIGS. 7A-B are VSWR and Smith chart response plots of an exemplary scale cage antenna using wires 16 of approximately of 76 feet (non-scaled). Here we see in FIG. 7A that the VSWR is below 4 for most of the desired frequency range. However, at around 310 MHz an unacceptable VSWR level is detected. Based on this result, the length of 76 feet (non-scaled) does not provide a better antenna than of FIGS. 6A-B. FIG. 7B shows the attendant Smith chart behavior.

Figure 8A:
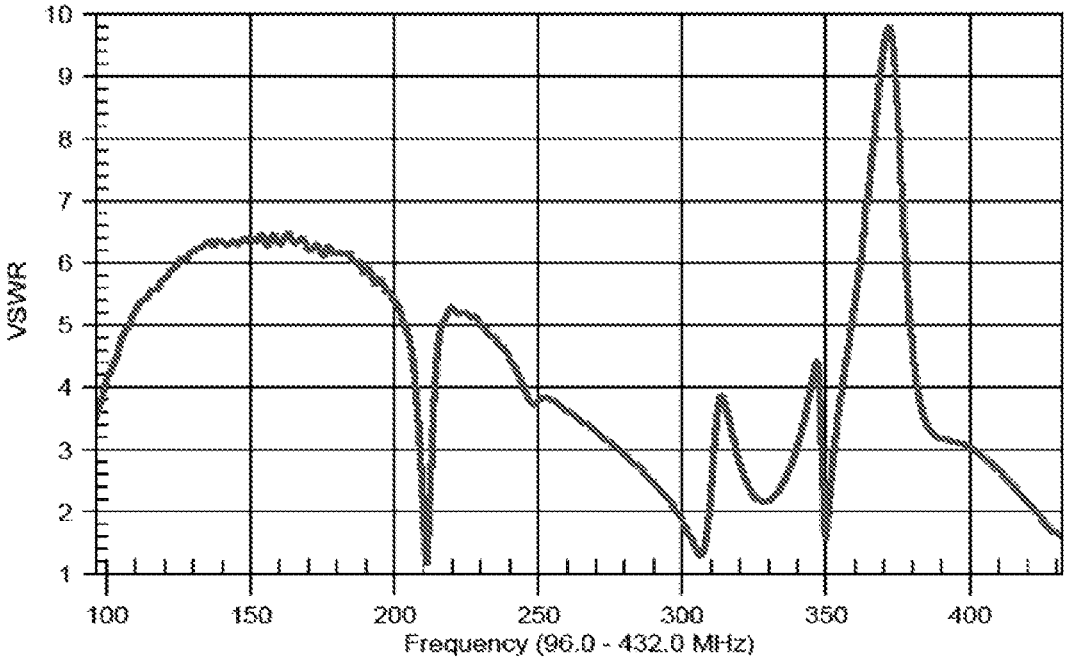
FIGS. 8A-B are VSWR and Smith chart response plots of another exemplary scale cage antenna system.
Figure 8B:
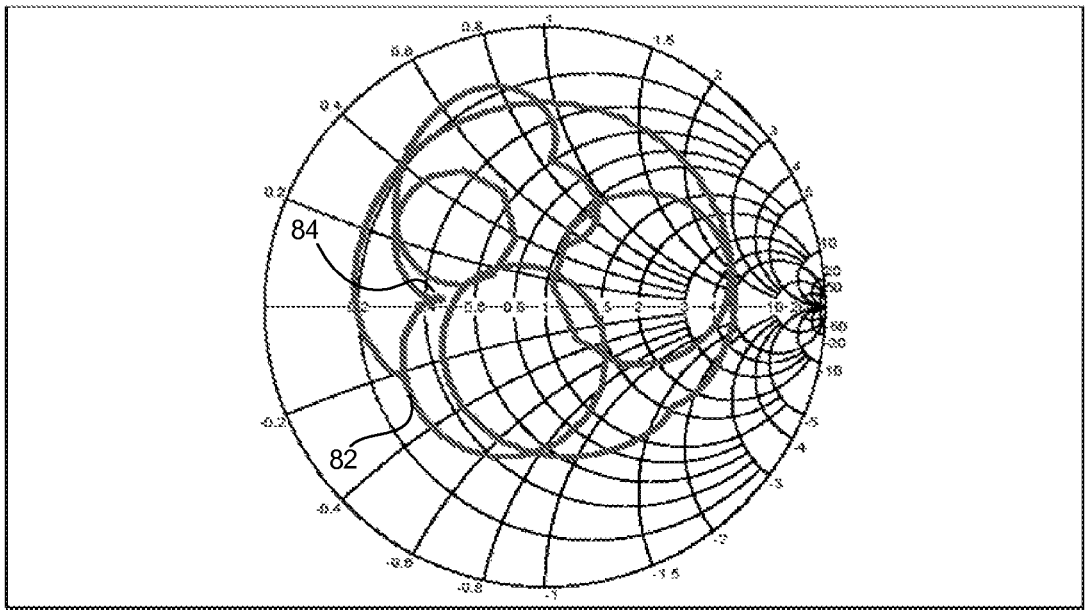

FIGS. 8A-B are VSWR and Smith chart response plots of the exemplary scale cage antenna of FIG. 2 placed over a large ground plane in an outdoor testing range. We see in FIG. 8A that the VSWR is markedly lower over the whole frequency range, though not sufficient for antenna performance acceptance. Consequently, it is understood that the size of the ground plane can affect the measured results. Given that the ocean is considered to have ground plane-like characteristics, this test scenario is understood to be more representative of actual conditions. FIG. 8B is the corresponding Smith chart showing the start frequency point 82 and the stop frequency point 84.

Based on the above results, it has been shown that a cage antenna having only four vertically oriented wires 16 can be successfully operated with a low VSWR between the non-scale frequencies of 2-7 MHz. Of course, as one of ordinary skill may be aware, other frequencies can be successfully operated in by appropriately adjusting the length of the vertically oriented wires 16, or in some instances the height of the cage antenna structure. As shown in the above embodiments, a reasonable and repeatable trial-and-error procedure was used to obtain the desired cage antenna, by simply increasing or decreasing the length of the vertically oriented wires 16, for a fixed cage antenna height on a fixed ship's mast 14. Thus, it is within the scope of this disclosure to implement other modifications, such as contouring the vertically oriented wires 16 in a more acute angle, for example, versus a smooth curve, to enable more degrees of freedom around the ship's mast 14. Or, to have the vertically oriented wires 16 form a gentle screw-thread like curve as they rise from the base of the mast 14. Also, fewer wires may be used, for example three vertically oriented wires 16, which would provide more spacing for accommodation of mast protrusions, other antennas, and such.

For reference purposes, the above cage antenna examples were tested using a pre-configured ship's mast 14 having a defined yardarm span and profile. The ship's mast 14 being at 1:48 scale, the equivalent non-scale dimensions of the ship's mast 14 would be:

Lower yardarm span of approximately 70 feet.

Upper yardarm span of approximately 60 feet.

Stub mast (portion above the upper yardarm) of approximately 28 feet.

Base of approximately 11 feet in diameter and approximately 4 feet in diameter at the top.

Using the above non-scaled dimensions, the cage antenna's overall height would be approximately 66 feet, from the bottom ring 18*b* to the top ring 18*a*. The diameter of the rings 18*a*, 18*b* would be approximately 11 feet. Thus, based on the type of ship's mast 14 being used, the cage antenna's parameters may be accordingly altered, without departing from the spirit and scope of this disclosure.

What has been described above includes examples of one or more embodiments. It is, of course, not possible to describe every conceivable combination of components or methodologies for purposes of describing the aforementioned embodiments. It will, therefore, be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. A broadband cage antenna about a conductive mast of a vessel, comprising:

a first plurality of wires aligned in a substantially vertical orientation and arranged circumferentially around the mast;

a second plurality of wires aligned in a substantially horizontal orientation and placed around the mast, a first wire of the second plurality of wires joining, near a top portion of the mast, all the first plurality of wires, and wherein the first wire forms a ring around the mast such that the ring extends through a loop formed by the interconnection of the mast, a top yard arm, and a supporting member of the top yard arm, and a second wire of the second plurality of wires joining, near a bottom portion of the mast, all the first plurality of wires; and an antenna feed coupled to the second wire of the second plurality of wires, wherein the first and second plurality of wires are electrically insulated from the mast, to form a broadband antenna having a VSWR response of less than 4 over a designated frequency range.

2. The broadband cage antenna of claim 1, wherein other antennas are placed on the mast between wires of the first plurality of wires.

3. The broadband cage antenna of claim 1, wherein the designated frequency range is 2-7 MHz.

4. The broadband cage antenna of claim 1, wherein the first plurality of wires form a prolate spheroid, capped by the second plurality of wires.

5. The broadband cage antenna of claim 1, wherein the first plurality of wires is comprised of four wires.

6. The broadband cage antenna of claim 1, further comprising at least one of a transmitter and receiver, coupled to the antenna feed.

7. A broadband cage antenna about a conductive mast of a vessel, comprising:

a plurality of first conducting means for conducting electrons, aligned in a substantially vertical orientation and arranged circumferentially around the mast;

a plurality of second conducting means for conducting electrons aligned in a substantially horizontal orientation and placed around the mast, a first conducting means of the plurality of second conducting means joining, near a top portion of the mast, all the plurality of first conducting means, and wherein the first conducting means forms a ring around the mast such that the ring extends through a loop formed by the inter-connection of the mast, a top yard arm, and a supporting member of the top yard arm, and a second conducting means of the plurality of the second conducting means joining, near a bottom portion of the mast, all the plurality of the first conducting means; and a feeding means for receiving or transmitting electricity, coupled to the second conducting means of the plurality of the second conducting means, wherein the pluralities of the first and second conducting means are electrically insulated from the mast, to form a broadband antenna having a VSWR response of less than 4 over a designated frequency range.

8. The broadband cage antenna of claim 7, wherein other antennas are placed on the mast between conducting means of the plurality of first conducting means.

9. The broadband cage antenna of claim 7, wherein the designated frequency range is 2-7 MHz.

10. The broadband cage antenna of claim 7, wherein the plurality of first conducting means form a prolate spheroid, capped by the plurality of the second conducting means.

11. The broadband cage antenna of claim 7, further comprising at least one of a transmitting means and a receiving means, coupled to the feeding means.

12. A method for broad band coupling of electromagnetic waves using a cage of wires placed about a conductive mast of a vessel, comprising:

aligning a first plurality of wires in a substantially vertical orientation in a circumferential arrangement around the mast;

aligning a second plurality of wires in a substantially horizontal orientation around the mast;

joining a first wire of the second plurality of wires, near a top portion of the mast, to all the first plurality of wires such that the first wire forms a ring around the mast and such that the ring extends through a loop formed by the interconnection of the mast, a top yard arm, and a supporting member of the top yard arm;

joining a second wire of the second plurality of wires, near a bottom portion of the mast, to all the first plurality of wires; and coupling an antenna feed to the second wire of the second plurality of wires, wherein the first and second plurality of wires are electrically insulated from the mast, to form a broadband antenna having VSWR response of less than 4 over a designated frequency range.

13. The method of claim 12, further comprising placing other antennas on the mast without physically interfering with the cage antenna.

14. The method of claim 12, wherein the designated frequency range is 2-7 MHz.

15. The method of claim 12, further comprising, conforming the first plurality of wires to form a prolate spheroid, capped by the second plurality of wires.

16. The method of claim 12, further comprising adjusting a length of the first plurality of wires to affect a VSWR response of the cage antenna.

17. The method of claim 12, further comprising elevating a position of the second wire of the second plurality of wires, to be farther from the bottom portion of the mast.

18. The method of claim 12, further comprising lowering a position of the first wire of the second plurality of the wires, to be farther from the top portion of the mast.

19. The method of claim 12, wherein the first plurality of wires comprise four wires.

20. The method of claim 12, further comprising at least one of a transmitting energy to the cage of wires and receiving energy from the cage of wires.

* * * * *